United States Patent [19]

Morrell

[11] Patent Number: 4,813,164

[45] Date of Patent: Mar. 21, 1989

[54] SNOWPLOW MOUNTING ASSEMBLY FOR FRONT-END LOADERS

[75] Inventor: John R. Morrell, Monson, Mass.

[73] Assignee: Hubco Industries, Inc., Monson, Mass.

[21] Appl. No.: 141,979

[22] Filed: Jan. 11, 1988

[51] Int. Cl.[4] ..... E02F 3/76

[52] U.S. Cl. ..... 37/117.5; 37/231; 37/DIG. 3

[58] Field of Search ..... 37/103, 117.5, 117, 37/DIG. 3, 231, 4

[56] References Cited

U.S. PATENT DOCUMENTS

| | | | |
|---|---|---|---|
| 2,634,873 | 4/1953 | Tedrow | 37/117.5 |
| 3,410,008 | 11/1968 | Standfuss | 37/231 |
| 3,470,631 | 10/1969 | Grimes | 37/231 |
| 3,665,622 | 5/1972 | Lamb | 37/231 |
| 4,037,681 | 7/1977 | Gorby | 37/117.5 |
| 4,056,250 | 11/1977 | Uchiyama | 37/103 |
| 4,619,060 | 10/1986 | Knowlton | 37/231 |

*Primary Examiner*—Eugene H. Eickholt
*Attorney, Agent, or Firm*—Donald S. Holland

[57] ABSTRACT

A simple apparatus is disclosed for mounting a large highway plow on the bucket of a front-end loader. The mounting assembly comprises a main frame member that has affixed to it two plow connectors projecting forward toward the plow and two parallel, "U"-shaped struts projecting backward toward the loader. The open ends of the "U"-shaped struts are connected to each other by reinforcing bars and thereby form a receiving slot for the bottom edge of the loader's bucket.

In operation, the plow connectors are positioned adjacent standard "ear" brackets of the plow and "cotter pin" securing rods pass through the connectors and ears, attaching the mounting assembly to the plow. To mount the plow and assembly onto the loader's bucket, the operator simply drives the lower edge of the bucket up the receiving slot of the assembly until the edge abuts the main frame. Two plow chains, affixed to the plow, are then secured to grab hooks on either side of the top edge of the bucket. The operator can then raise the bucket, which raises the mounted assembly and plow, to transport to the surface to be plowed. Tilting the bucket forward until the plow contacts the surface to be plowed allows plowing without having the mounting assembly or bucket contact the surface. Lowering the bucket to the surface, freeing the plow chains from the hooks and backing out of the receiving slot dismounts the plow and assembly from the bucket.

9 Claims, 3 Drawing Sheets

SNOWPLOW MOUNTING ASSEMBLY FOR FRONT-END LOADERS

BACKGROUND OF THE INVENTION

The present invention relates to devices for mounting snowplows onto bucket type front-end loaders for temporary operation of the snowplow.

Public highway maintenance departments are frequently faced with a need to utilize common equipment for auxiliary or secondary purposes. Often, severe winter snowstorms require use of all vehicles at a department's disposal to expedite snow removal. Similary, when a truck that would normally mount a snowplow is mechanically disabled, the detached snowplow is affixed to any available vehicle. Further, when all the highway snowplows have been deployed, it is often convenient to employ a spare plow for local plowing of the department's yard or for slower-paced, tidying-up work, e.g., around fire hydrants, after the highway plows have moved through.

The most common vehicle for such alternative use is the large, front-end bucket loader. Because virtually all highway departments have front-end loaders for earth moving and truck filling operations, a variety of attachments have been designed to enable the loaders to perform numerous secondary tasks. Some of these attachments, such as U.S. Pat. No. 4,597,205, are specifically designed to mount a snowplow onto the bucket of a front-end loader.

Although previous snowplow mounting attachments allow use of front-end loaders for temporary snowplowing, they suffer from many deficiencies which are overcome by the present invention.

The most common problem associated with prior attachments is that they typically involve close-tolerance securing mechanisms that include many moving parts. Experience has demonstrated that, under winter use conditions involving repeated exposure to snow, ice, sand and salt, such complicated mechanisms are subject to jamming, freezing and rusting. Consequently, the moving parts often become inoperable, or, even worse, break under excess force applied in attempting to free them.

Many snowplow mounting attachments necessitate bolting or welding fixtures or making modifications to the loader's bucket to assist in securing the plow to the loader. Frequently, however, such changes to the loader will impair normal loader operation. Invariably, such changes involve significant costs in manpower in applying the fixtures or making the modifications.

Most known snowplow mounting attachments rigidly affix the plow to the loader. Accordingly, because the plow blade s well forward of the loader's wheels, the blade does not efficiently track the vertical contours of the plowed surface. Additionally, current mounting attachments are not routinely interchangeable between the wide variety of large highway plows, nearly all of which have standard mounting brackets.

Accordingly, it is the primary object of the present invention to provide an improved snowplow mounting assembly for front-end loaders that utilizes no moving parts.

It is another object to provide a mounting assembly which securely affixes a snowplow to a front-end loader without adding fixtures or making modifications to the loader.

It is another object to provide a mounting assembly that efficiently tracks the vertical contours of the plowed surface.

It is yet another object to provide a mounting assembly that is easily interchangeable between the wide variety of large highway plows that have standard mounting brackets.

The above and other objects and advantages of this invention will become more readily apparent when the following description is read in conjunction with the accompanying drawings.

SUMMARY OF THE INVENTION

A simple apparatus is disclosed for mounting snowplows to the buckets of front-end loaders. This device is attached to the standard, ear-type, mounting brackets of highway snowplows by simple, "cotter pin" securing rods and is mounted onto the loader's bucket by a receiving slot and two chains.

In the preferred embodiment, the invention comprises a main frame member that has two plow connectors extending forward toward the plow and two "U"-shaped, parallel struts extending backward toward the loader. The open ends of the two struts form a receiving slot for the loader's bucket, and are connected to each other by two parallel reinforcing bars.

In operation, the plow connectors are positioned such that the two holes in each of the connectors' two parallel mounting plates are aligned on either side of each of the plow's ear brackets. Securing rods pass through the holes in the plates and the plow's ears to attach the mounting assembly to the plow.

To mount the plow onto the loader, the operator simply guides the lower edge of the loader's bucket into the receiving slot until the edge abuts the main frame member. Two standard chains attached to the plow are then hooked to the standard grab hooks on either side of the top edge of the loader's bucket. The snowplow is then ready for use.

To disconnect the snowplow from the loader, the operator merely unhooks the two chains and backs the loader's bucket out of the receiving slots. To disconnect the mounting assembly from the plow, the operator simply pulls the securing rods from the plow connectors.

DETAILED DESCRIPTION OF THE PREFERRED EMBODIMENT

Figures 1, 5:
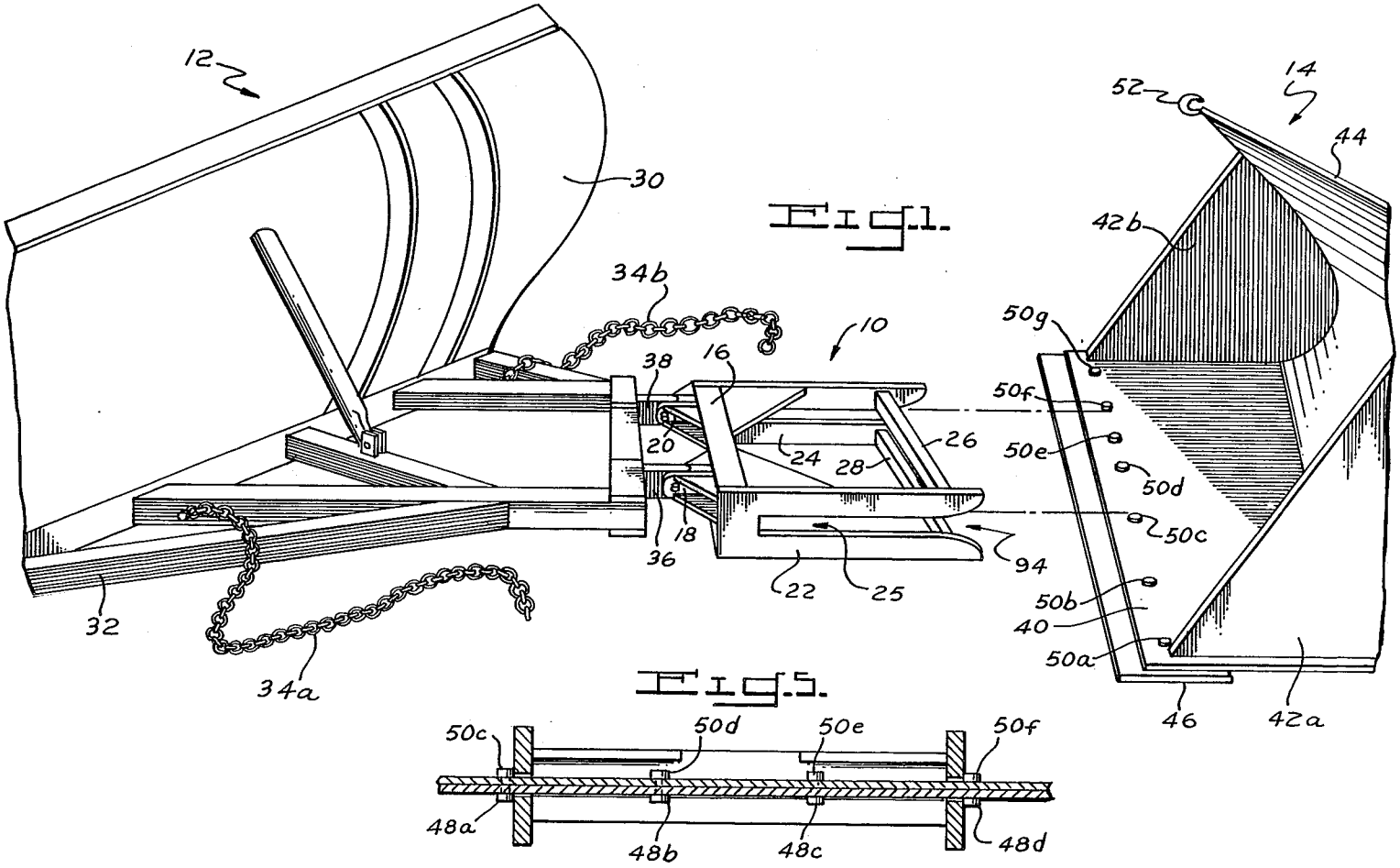
FIG. 1 is a side perspective view of a snowplow mounting assembly for standard front-end loaders constructed in accordance with the present invention, wherein the mounting assembly is attached to a standard highway snowplow and the bucket of a standard front-end loader is positioned in preparation for insertion into the assembly.
FIG. 5 is a cross-sectional view, taken along line 5—5 of FIG. 2, showing the spacing between a receiving slot of the mounting assembly and nuts securing a cutting edge to the bottom edge of the bucket.

Referring to the drawings in detail, the preferred embodiment of a snowplow mounting assembly for front-end loaders is shown and generally designated by the reference numberal 10. The assembly 10 can be easily attached to a standard highway plow 12, both of which can then be mounted on a bucket 14 of a front-end loader (not shown). As best shown in FIG. 1, the mounting assembly 10 basically comprises a main frame member 16 which abuts the bucket 14 when in use; two plow connectors 18, 20 for attaching the assembly 10 to the plow 12; two "U"-shaped, parallel struts 22, 24 which form a bucket receiving slot 25; and two reinforcing bars 26, 28 that connect the open ends of the struts.

The standard highway snowplow 12 includes a plow blade 30 that is affixed to the front of a support frame 32. Two plow chains 34*a,b* are secured to the support frame for raising, lowering and securing the plow. Affixed to the side of the support frame 32, that is opposite the plow blade 30, are two "ear" brackets 36, 38 for attaching the plow to vehicles. On virtually all highway plows these ears 36, 38 are of standard dimensions. They are set apart from each other a standard width to allow plow vehicles (not shown) to easily mount a variety of blades.

The bucket 14 of the large front-end loaders includes a lower edge 40, two side walls 42*a,b* and a top edge 44. A cutting edge 46 is affixed to the underside of the bucket's lower edge 40 and extends outward (see FIG. 1) beyond the lower edge. The cutting edge 46 protects the bucket's lower edge 40 from routine wear and tear and is designed to be replaced at specific intervals. To assist replacement, the cutting edge 46 is secured to the lower edge 40 by bolts 48*a,b,c,d* (see FIG. 5) and nuts 50*a, b,c,d,e,f,g* (see FIGS. 1, 2). On both outer corners of the top edge 44 of the bucket are standard grab hooks 52 (only one shown in FIGS. 1, 2) that serve many tasks, including securing chains.

Figure 3:
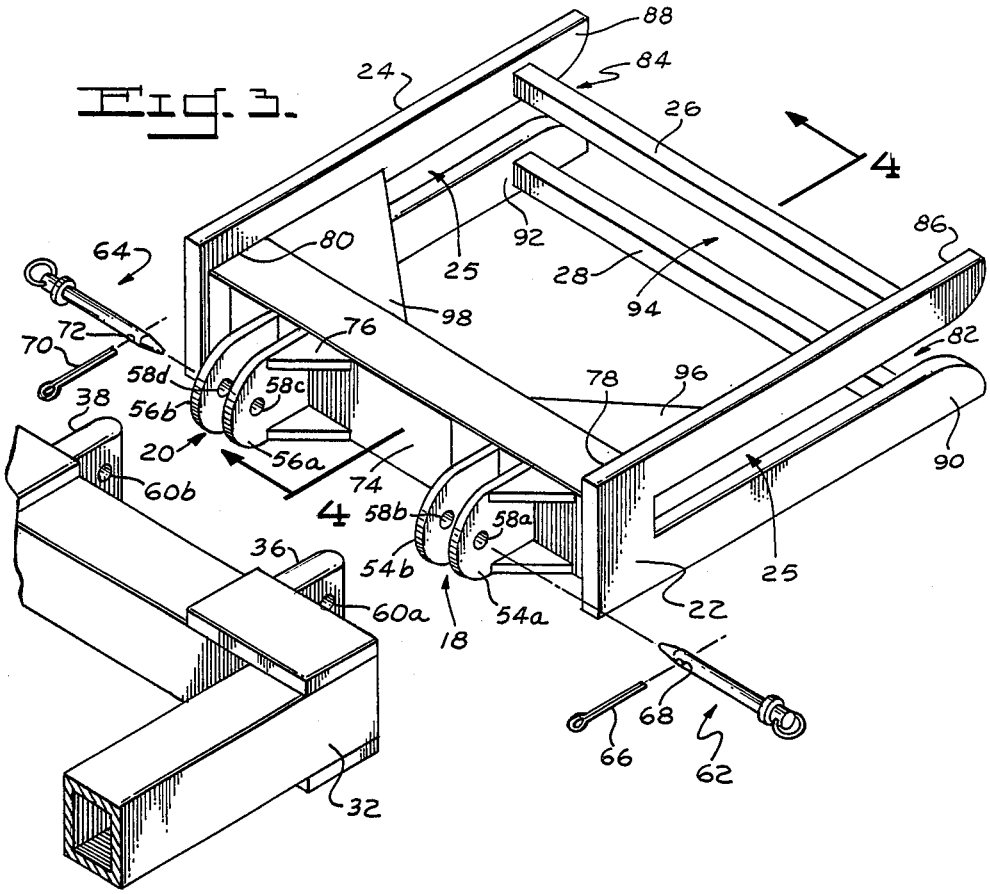
FIG. 3 is a front perspective view of the mounting assembly, showing the assembly's plow connectors and their "cotter pin" securing rods.
Figure 4:
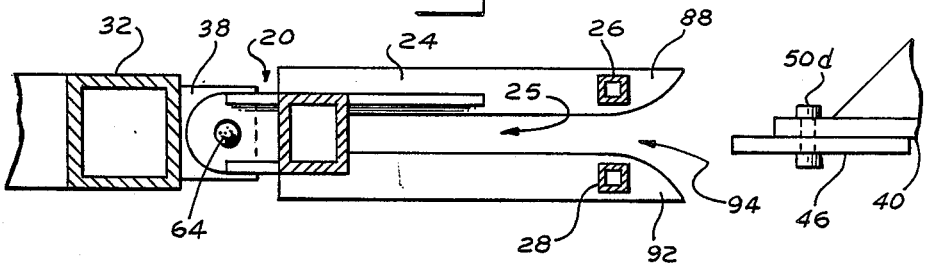
FIG. 4 is a fragmentary cross-sectional view, taken along line 4—4 of FIG. 3, showing the plow and the bottom edge of the bucket positioned in prepartion for insertion into the assembly.

The mounting assembly 10 is made of any suitable material such as steel. As best shown in FIG. 3, the plow connectors 18, 20 are positioned on the main frame member 16 to align with the ear brackets 36, 38 of the plow 12. When the assembly 10 is to be attached to the plow, parallel mounting plates 54*a,b* of plow connector 18 form a channel that receives ear bracket 36 of the plow. Similarly, mounting plates 56*a,b* of connector 20 receive ear bracket 38.

Mounting plates 54*a,b* and 56*a,b* have holes 58*a,b,c,d,* that align with holes 50*a,b* in the ears 36, 38. A "cotter pin" securing rod 62 passes through holes 58*a,b* of plow connector 18 and hole 60*a* of ear 36. Similarly, securing rod 64 passes through holes 58*b,c* of plow connector 20 and hole 60*b* of ear 38. Pin 66 slides through lock hole 68 of rod 62 and pin 70 likewise passes through lock hole 72 of rod 64 to prevent the securing rods 62, 64 from vibrating or sliding out of their positions. This completes the attachment of mounting assembly 10 to the snowplow 12.

Plow connectors 18 and 20 are rigidly affixed to a front face 74 of the main frame member 16. For added structural strength, identical triangular reinforcement ribs, e.g., 76 (see FIG. 3) may be affixed between the mounting plates 54*a,b* and 56*a,b* and the front face 74 of the main frame 16.

The main frame member 16 is a rectangular channel that has a "U"-shaped strut 22 affixed to one end 78 and another strut 24 at the other end 80. Both struts 22, 24 extend away from the main frame member 16 in a direction that is opposite to the extension of plow connectors 18, 20. The struts 22, 24 are parallel to each other and the open end 82 of strut 22 is directly opposite and facing the open end 84 of strut 24.

Reinforcing bar 26 extends between the outer portion of the top branch 86 of strut 22 and the outer portion of the top branch 88 of strut 24. Reinforcing bar 28 extends between the outer portion of the bottom branch 90 of the strut 22 and the outer portion of the bottom branch 92 of strut 24. The reinforcing bars 26, 28 and the open ends 82, 84 of the "U"-shaped struts define the mouth 94 of receiving slot 25. For added structural strength, triangular reinforcing ribs 96, 98 may be affixed between struts 22, 24 and the main frame 16.

Figure 2:
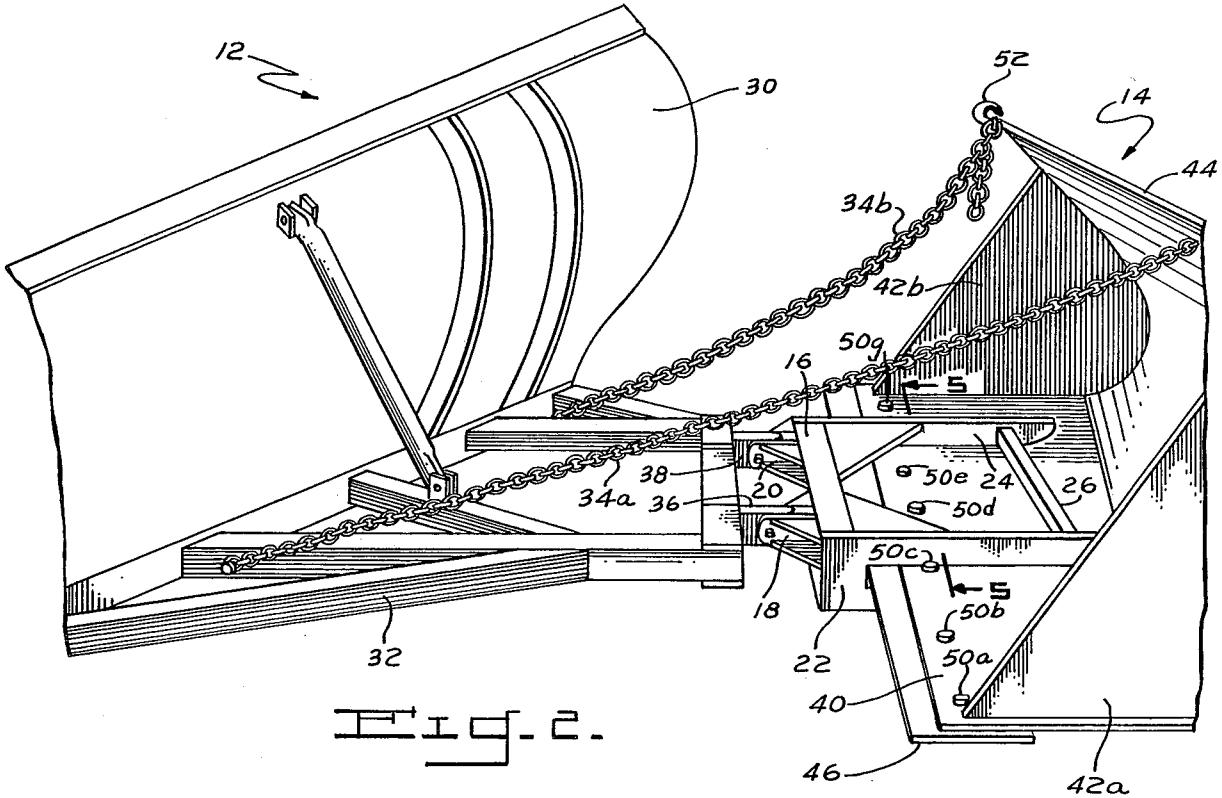
FIG. 2 is a side perspective view of the FIG. 1 mounting assembly, showing the bucket of the front-end loader inserted into the assembly and the plow mounted onto the loader.

Operation of the preferred embodiment is best shown in FIGS. 1, 2. The mounting assembly 10 is positioned so that the plow connectors' 18, 20 mounting plates (54*a,b* and 56*a,b*) receive the plow's 12 ear brackets 36, 38. Securing rods 62, 64 are inserted through the holes 58*a,b,c,d* in the mounting plates and the aligned holes 60*a,b* in the ear brackets 36, 38. Pins 66, 70 are inserted through the lock holes 68, 72 of the securing rods 62, 64. The mounting assembly 10 is thereby attached to the highway snowplow.

The assembly 10 may be quickly attached to a plow in this manner each time use of the plow by a front-end loader bucket 14 is required. Alternatively, if a highway department has a spare plow or a plow specifically for front-end loader use, the mounting assembly 10 may remain attached to that plow for the entire plowing season.

To mount the plow 12 and attached assembly onto the bucket 14 of a front-end loader, the loader operator aligns the bucket so that the bucket side walls 42*a,b* are just inside any two nuts 50*a,b,c,d,e,f,g* see FIG. 5). The operator may choose two nuts that are in the center of bucket 14 or two that are offset left or right, depending upon the plowing requirements. Contact between the nuts and the parallel "U"-shaped struts 22, 24 prevents the assembly 10 and plow 12 from sliding sideways during turning maneuvers. The operator then drives the lower edge 40 of the bucket through the receiving slot 25 of the mounting assembly 10 until the cutting edge 46 abuts the assembly's main frame member 16. The operator next secures each of the plow chains 34*a,b* to the particular grab hook 52 on the top edge 44 of the bucket 14 that the chain is closest to. This completes the mounting of the snowplow.

To transport the snowplow, the operator raises the loader's bucket 14 and, as the plow chains 34*a,b* become taut, the plow rises with the bucket. In order to start snowplowing, the operator lowers the bucket 14 until the mounting assembly is six to eight inches off the ground. Then, the operator angles or tilts (not lowers) the bucket 14 downward until the plow blade 30 touches the plowing surface. Consequently, during plowing, while the plow blade 30 contacts the plowing surface, the mounting assembly 10 and bucket 14 remain above the ground, free from wear and tear.

To disconnect the plow 12 and mounting assembly 10 from the loader, the operator only has to lower the bucket 14 to the ground, free the plow chains 34*a,b* from the grab hooks 52 and back the bucket 14 out of the mounting assembly's receiving slot 25. Disconnection may easily be performed during plowing operations to enable the bucket 14 to move piles of accumulated snow, if necessary. The mounting assembly 10 may be disconnected from the plow 12 by simply removing pins 66, 70 from securing rods 62, 64 and removing the rods from the plow connectors 18, 20.

It should be understood by those skilled in the art that obvious structural modifications can be made without departing from the spirit of the invention. Accordingly, reference should be made primarily to the accompanying claims rather than the foregoing specificiation to determine the scope of the invention.

Having thus described the invention, what is claimed is:

1. A mounting assembly apparatus for attaching a standard highway snowplow to a standard bucket on a front-end loader, wherein the snowplow includes a plow blade supported by a frame having two affixed plow chains and two ear brackets, which are of standard dimensions and standard distances apart, for attaching and securing the snowplow to vehicles, wherein the bucket includes a lower edge having a cutting edge connected thereto by nuts and bolts with said nuts protruding above and being positioned along the edges a standard distance apart from each other and the bucket also includes an upper edge with standard grab hooks affixed to each outer corner, the mounting assembly comprising:

a. a main frame member;

b. a pair of plow connectors affixed to the main frame member and extending forward toward the plow, wherein the connectors are positioned substantially the same distance apart as the distance separating the ear brackets on the plow and wherein each plow connector includes a set of two parallel, adjacent mounting plates having central holes that are adapted to align with corresponding holes in the plow's standard ear brackets, whereby each set of plates forms a channel to receive one of the ear brackets, and the apparatus further includes two securing rods, whereby the plow is attached to the assembly when the securing rods are passed through the holes in the connector's mounting plates and the ears within the channel of each connector;

c. a pair of "U"-shaped struts affixed in parallel alignment to the main frame member and extending rearward toward the bucket with the open ends of the struts adjacent the bucket; and d. a pair of reinforcing members affixed in parallel alignment between the open ends of each "U"-shaped strut, connecting the open end of one strut to the open end of the other strut and thereby forming a receiving slot, wherein the width of the slot is slightly less than the width between any two of the nuts that secure the cutting edge to the lower edge of the bucket, so that the nuts secure the assembly against lateral sliding of the assembly when the assembly is mounted on the bucket.

2. A mounting assembly apparatus for attaching a standard highway snowplow to a standard bucket on a front-end loader, wherein the snowplow includes a plow blade supported by a frame having two affixed plow chains and two ear brackets, which are of standard dimensions and standard distances apart, for attaching and securing the snowplow to vehicles, wherein the bucket includes a lower edge having a cutting edge connected thereto by nuts and bolts with said nuts protruding above and being positioned along the edges a standard distance apart from each other and the bucket also includes an upper edge with standard grab hooks affixed to each outer corner, the mounting assembly comprising:

a. a main frame member;

b. a pair of plow connectors affixed to the main frame member and extending forward toward the plow, wherein the connectors are positioned substantially the same distance apart as the distance separating the ear brackets on the plow;

c. a pair of "U"-shaped struts affixed in parallel alignment to the main frame member and extending rearward toward the bucket with the open ends of the struts adjacent the bucket; and d. a pair of reinforcing members affixed in parallel alignment between the open ends of each "U"-shaped strut, connecting the open end of one strut to the open end of the other strut and thereby forming a receiving slot.

3. The apparatus of claim 2 wherein the plow connectors comprise parallel plates having central holes that are adapted to align with corresponding holes in the plow's ear brackets, whereby the holes in the plates and brackets are each adapted to receive a securing rod through them to attach the snowplow onto the mounting assembly.

4. The apparatus of claim 2 wherein each plow connector comprises a set of two parallel, adjacent mounting plates having central holes that are adapted to align with corresponding holes in the plow's standard ear brackets, whereby each set of plates forms a channel to receive one of the ear brackets; and the apparatus further includes two securing rods, whereby the plow is attached to the assembly when the securing rods are passed through the holes in the connector's mounting plates and the ears within the channel of each connector.

5. The apparatus of claim 4 wherein the securing rods are held within the connectors' holes by a cotter pin passing through a slot in each rod.

6. The apparatus of claim 2 wherein the width of the receiving slot in the mounting assembly is slightly less than the width between any two of the nuts that secure the cutting edge to the lower edge of the bucket, so that the nuts secure the assembly against lateral sliding of the assembly when the assembly is mounted on the bucket.

7. An apparatus comprising:

a. a highway snowplow that includes a plow blade that is supported by a frame having two plow chains and two ear brackets, which are of standard dimensions and standard distances apart, for attaching and securing the snowplow to vehicles;

b. a bucket on a front-end loader that includes a lower edge having a cutting edge connected thereto by nuts and bolts that are positioned along the edges a standard distance apart from each other and the bucket also includes an upper edge with standard grab hooks affixed to each outer corner;

c. a mounting assembly for connecting the snowplow to the bucket comprising:

i. a main frame member;

ii. a pair of plow connectors affixed to the main frame member and extending forward toward the plow, wherein the connectors are substantially positioned the same distance apart as the distance separating the ear brackets on the plow and wherein each plow connector includes a set of two parallel, adjacent mounting plates having central holes that are adapted to align with corresponding holes in the plow's standard ear brackets, whereby each set of plates forms a channel to receive one of the ear brackets, and the apparatus further includes two securing rods, whereby the plow is attached to the assembly when the securing rods are passed through the holes in the connector's mounting plates and the ears within the channel of each connector, and the rods are held within the holes in the connector by cotter pins passing through a slot in each rod;

iii. a pair of "U"-shaped struts affixed in parallel alignment to the main frame member and extending rearward toward the bucket with the open ends of the struts adjacent the bucket and with triangular shaped reinforcing ribs connected between the struts and the main frame member; and iv. a pair of reinforcing members affixed in parallel alignment between the open ends of each "U"-shaped strut, connecting the open end of one strut to the open end of the other strut and thereby forming a receiving slot, wherein the width of the slot is slightly less than the width between any two of the nuts that secure the cutting edge to the lower edge of the bucket, so that the nuts secure the assembly against lateral sliding of the assembly when the assembly is mounted on the bucket.

8. A method for rapid mounting of a standard highway plow onto a standard bucket of a front-end loader, wherein the snowplow includes a frame that has two plow chains affixed and two ear brackets, which are of standard dimensions and standard distances apart, for attaching and securing the snowplow to vehicles and wherein the bucket includes a lower edge that has a cutting edge connected thereto by nuts and bolts with said nuts protruding above and being positioned along the edges a standard distance apart from each other and the bucket also includes an upper edge with standard grab hooks affixed to each outer corner, said mounting method comprising the steps of:

a. aligning the ear brackets of the plow within a pair of plow connectors attached to a frame;

b. passing securing rods through holes in the plow connectors and the ear brackets;

c. inserting the lower edge of the bucket within a receiving slot of the frame; and d. securing the plow chains to the grab hooks on the bucket.

9. The rapid mounting method as recited in claim 8, further comprising the step of aligning the bucket so that two nuts on the edge of the bucket are adjacent outside edges of the receiving slot to secure the attached snowplow against lateral sliding.

* * * * *